United States Patent [19]

Carter

[11] 4,047,791

[45] Sept. 13, 1977

[54] LOW INSERTION FORCE RECEPTACLE AND CAMMED HOUSING

[75] Inventor: Clyde Thomas Carter, Shermansdale, Pa.

[73] Assignee: AMP Incorporated, Harrisburg, Pa.

[21] Appl. No.: 658,158

[22] Filed: Feb. 17, 1976

Related U.S. Application Data

[60] Continuation of Ser. No. 530,262, Dec. 6, 1974, abandoned, which is a division of Ser. No. 367,072, June 4, 1973, Pat. No. 3,865,457.

[51] Int. Cl.[2] ..... H01R 13/12

[52] U.S. Cl. ..... 339/260

[58] Field of Search ..... 339/258, 260, 261, 74

[56] References Cited

U.S. PATENT DOCUMENTS

| | | | |
|---|---|---|---|
| 1,294,656 | 2/1919 | Hammond | 339/261 |
| 1,662,946 | 3/1928 | Baltzley | 339/260 |
| 2,120,396 | 6/1938 | Domaleski | 339/258 RR |
| 2,743,428 | 4/1956 | Martines | 339/258 P |

*Primary Examiner*—Joseph H. McGlynn
*Attorney, Agent, or Firm*—Allan B. Osborne; Gerald K. Kita

[57] ABSTRACT

The present invention relates to a receptacle and also a zero insertion force connector in the form of an electrical receptacle mounted within a housing. The housing is provided with an apertured cover which is movable on the housing to one position in order to bias the receptacle to an open position, allowing a male contact to be inserted through the apertured cover and into the receptacle without substantial resistance to insertion thereof. The cover is subsequently moved to a second position on the housing to release the receptacle and allow the receptacle to resiliently close and grip on the male contact, thereby electrically terminating the male contact to the receptacle within the housing. As a further feature of the invention, the receptacle is of stamped and formed configuration having a body portion with a pair of opposed gripping portions projecting therefrom. Means are provided on the body portion to distribute the resilient deflection of the spring fingers substantially along the length of the body portion, such that a gripping force is provided by the cumulative deflections of the spring fingers and the body portion together. Also the tendency for unfolding of the body portion as the spring fingers are deflected in greatly aleviated by distribution of the deflection along a substantial length of the body portion.

4 Claims, 17 Drawing Figures

Fig. 13
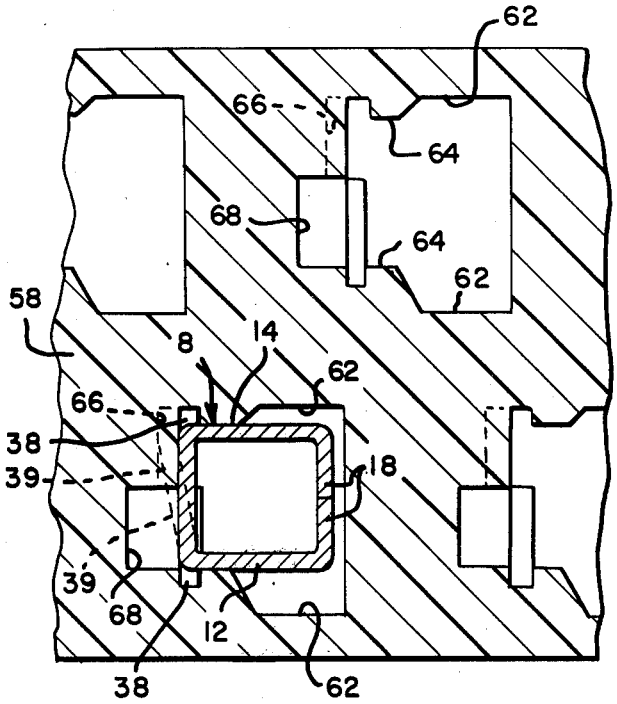
Fig. 14
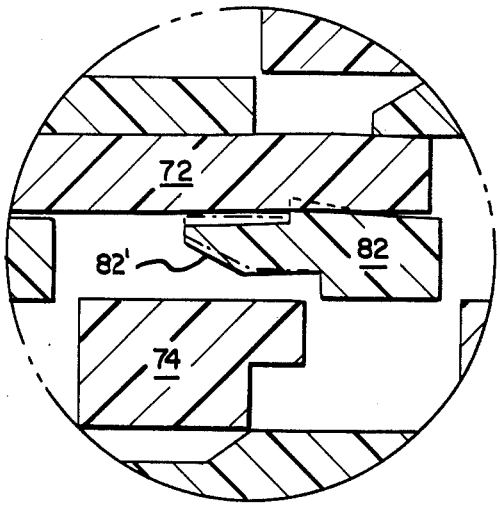
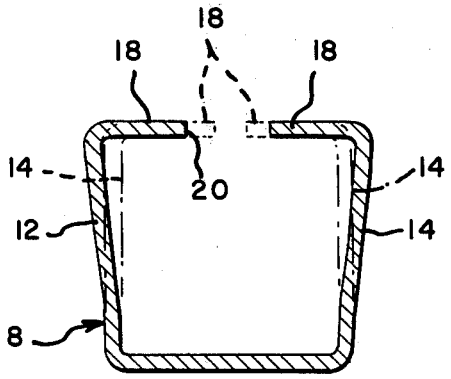
Fig. 6
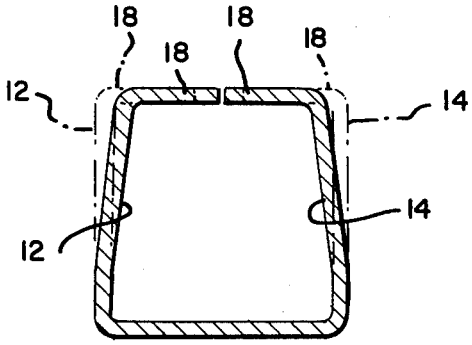
Fig. 7

LOW INSERTION FORCE RECEPTACLE AND CAMMED HOUSING

This is a continuation, of application Ser. No. 530,262 filed Dec. 6, 1974, abandoned, which is a division of Ser. No. 367,072, filed June 4, 1973, now U.S. Pat. No. 3,865,457.

The present invention relates to a receptacle and also a zero insertion force connector in the form of an electrical receptacle mounted within a housing. The housing is provided with an apertured cover which is movable on the housing to one position in order to bias the receptacle to an open position, allowing a male contact to be inserted through the apertured cover and into the receptacle without substantial resistance to insertion thereof. The cover is subsequently moved to a second position on the housing to release the receptacle and allow the receptacle to resiliently close and grip on the male contact, thereby electrically terminating the male contact to the receptacle within the housing. As a further feature of the invention, the receptacle is of stamped and formed configuration having a body portion with a pair of opposed gripping portions projecting therefrom. Means are provided on the body portion to distribute the resilient deflection of the spring fingers substantially along the length of the body portion, such that a gripping force is provided by the cumulative deflections of the spring fingers and the body portion together. Also the tendency for unfolding of the body portion as the spring fingers are deflected is greatly alleviated by distribution of the deflection along a substantial length of the body portion.

Accordingly, it is an object of the present invention to provide a zero insertion force connector in the form of a dielectric housing containing at least one resilient electrical terminal which resiliently closes into gripping relationship on a male electrical terminal inserted within the housing, with the receptacle being positively biased by said housing to an open position allowing the male electrical terminal to be received within the housing without resistance to insertion within the receptacle.

Another object of the present invention is to provide an electrical terminal in the form of a stamped and formed receptacle having a body portion and a pair of projecting resilient spring fingers, the fingers being resiliently deflectable toward each other to grip therebetween a male electrical terminal, and the body portion being provided with a series of cutouts which distribute deflection of the spring fingers into a corresponding deflection along a substantial length of the body portion, whereby gripping pressure may be applied at the spring fingers by the resilient deflection of the spring fingers and the body portion, rather than by deflection merely of the spring fingers alone.

Another object of the present invention is to provide an electrical receptacle which provides a gripping force by resilient deflection of a pair of opposed spring fingers, whereby deflection of the spring fingers is transmitted into a corresponding deflection of a body portion of the receptacle to provide a resilient gripping force at the fingers produced by the cumulative deflections of the spring fingers and the body portion together.

Another object of the present invention is to provide an electrical terminal folded into a receptacle wherein the seam of the receptacle is provided with opposed margins which are formed with angular edges compressed together thereby preloading the receptacle despite the slightly open configuration of the receptacle.

Other objects and many attendant advantages of the present invention will become apparent upon perusal of the following detailed description taken in conjunction with the accompanying drawings.

FIG. 6 is an enlarged section taken along the line 6—6 of FIG. 1;

FIG. 7 is an enlarged section taken along the line 7—7 of FIG. 1;

FIG. 8 is an enlarged perspective of a housing and cover portion for containing a terminal as shown in FIG. 1;

FIG. 13 is an enlarged fragmentary section taken along the line 13—13 of FIG. 10;

FIG. 14 is a magnified view of the view-outlined portion of FIG. 11 illustrating the detail permitting latching of the cover to the housing;

Figures 1, 2, 3, 4, 5:
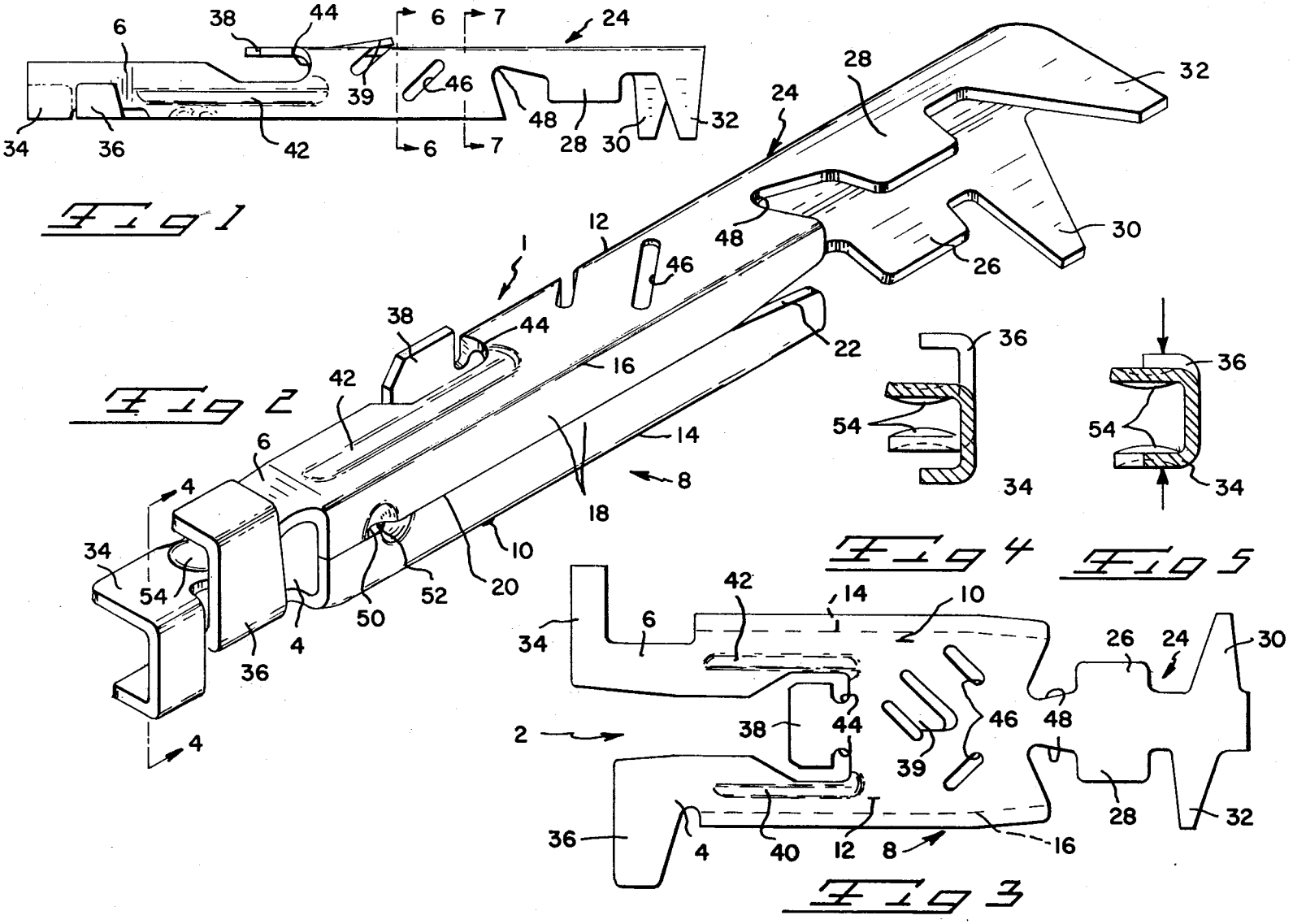
FIG. 1 is an enlarged elevation of a unitary electrical terminal in the form of a receptacle according to the preferred embodiment of the present invention.
FIG. 2 is an enlarged perspective of the terminal illustrated in FIG. 1.
FIG. 3 is an enlarged plan of a stamped and formed metal blank to be subsequently formed into the terminal as illustrated in FIG. 1.
FIG. 4 is an enlarged fragmentary section taken along the line 4—4 of FIG. 2.
FIG. 5 is an enlarged fragmentary section of the preferred embodiment illustrated in FIG. 4 illustrating another mode of operation.

With more particular reference to FIGS. 1, 2 and 3, an electrical terminal according to the present invention will be described in detail. The terminal, illustrated generally at 1, in FIG. 1, comprises a stamped and formed electrical terminal in the form of a receptacle which is fabricated from a blank illustrated in FIG. 3 generally at 2. The terminal includes a pair of elongated spring fingers which extend in cantilever fashion integral with a body portion generally indicated at 8. As shown the body portion 8 is formed into a box configuration having opposed sidewalls 10 and 12 with another sidewall being formed by a pair of folded margins 14 and 16 defining a pair of elongated portions 18 separated by a seam 20. At one end, the seam 20 widens into a dovetail notch 22 for a purpose to be described hereinafter. In addition, the body portion 8 of the receptacle is integral with a crimp barrel portion 24 comprised of a pair of conductor crimping ears 26 and 28 adjacent a pair of insulation crimping ears 30 and 32. For example, the ears 26 and 28 are adapted to be folded around and crimped onto an exposed conductor wire, where as the ears 30 and 32 are adapted to be curled over and crimped into engagement in insulation which covers the wire. Such a crimped configuration on an insulated wire is in accordance with accepted practices available in the prior art.

At the other end of the body portion 8 the fingers 4 and 6 extend longitudinally of the box configuration body, and terminate in a pair of corresponding channel shaped actuating jaws 34 and 36. As shown, the actuating jaws 34 and 36 are in tandem relationship, generally formed to U-shaped channel end configurations which are biased past each other such that the U-shaped channel end portion of one does not coincide in alignment with the U-shaped channel portion of the other.

As shown more paticularly in FIGS. 1, 2 and 3, the terminal is provided along a bottom wall thereof, which joins the walls 10 and 12, with a generally laterally extending T-shaped flange 38 which is generally in the same plane as the bottom wall of the box shaped configuration body portion 8 but which has the arms of the T-shaped portion positioned generally along the walls 10 and 12 for a locking the terminal within a corresponding cavity of a housing, to be further explained in detail. With reference to the same FIGURES, the spring arms 4 and 6 are provided with formed elongated flutes or valleys 40 and 42 extending from the body portion 12 and into the cantilever configuration of the spring arms, the flutes being provided to stiffen and prevent bowing of the spring arms in cantilever deflection as will be explained in detail hereinafter. The terminal also is provided in each of the walls 10 and 12 with cutout portions 44, 46 and 48. As shown the cutout portions are generally elongated in configuration with rounded end portions extending diagonally toward one another, thereby defining in each sidewall 10 and 12 a pair of torsional elements generally in tandem relationship to a corresponding spring finger and 4 and 6. The operation of the torsional elements will be defined in detail hereinafter.

In addition, the body portion 88 is further provided with a pair of recessed dimples 50 and 52 on the overlapping margins of the body portions 18, such that the dimples 50 and 52 oppose each other along the seam 20. The dimples 50 and 52 are offset from one another to provide undulations along seam 20 which are in abutment with each other to prevent the portions 18 from overlapping each other. This allows the box configuration of the terminals to be folded closed with a substantial compression along the seam 20, without causing overlapping of the portions 18. Such compression allows the spring arms 4 and 6 to be prestressed. More particularly, when the spring arms 4 and 6 are resiliently deflected away from each other in a manner to be described, such deflection will accordingly not cause separation of the body portion along the seam 20, until the deflections of the spring arms are sufficiently great to overcome the compression forces along the seam 20. Accordingly, when such compression forces are overcome, the body portion will tend to separate slightly along the seam 20. This will cause the dovetail groove 22 to slightly close up, in a manner to be explained. Thus, the body is designed to slightly open along its seam 20 adjacent the spring elements, but slightly close at the remaining end of the body portion along the seam at the dovetail portion 22. This phenomenum is specifically required such that deflection of the spring elements also cause a corresponding deflection of the body portion length along its seam 20. Such deflection of the body portion creates resilient spring energy therein which is transferred to the spring arms. When a male terminal is received between the resiliently spread apart spring arms, the gripping forces of the spring arms on the terminal will be caused by the resilient deflection of the spring arms themselves and also the resilient deflection in the body portion. Such provides a substantial resilient gripping force on the male terminal, without relying merely upon the spring arms themselves to provide the gripping force. Such provides a substantial gripping force on the male terminal with but a minimum amount of spread apart deflection required by the spring arms to create such a resilient gripping force. Accordingly, the receptacle according to the present invention need not require a large amount of clearance surrounding the terminal to allow for large amounts of deflection in the spring arms. Instead with a relatively small amount of deflection, substantial gripping forces can be applied by the spring elements on a received male terminal. The receptacle 1 according to the present invention thus may be located in a relatively small space and can be grouped together with other receptacles very closely; features which would not be permissible if relatively large deflections of the spring arms were required.

By reference to FIGS. 6 and 7, the resilient deflection of the body portion will be described in detail. FIG. 6 illustrates the body portion being resiliently deflected apart along the section 6—6 of FIG. 1. The body portions 18 which are adjacent to the margin 20 are illustrated as being resiliently deflected apart from one another, greatly exaggerated for purposes of illustration. Shown in phantom outline are the same margin portions 18 which appear at the section 7—7 of the body portion. It is shown that the margin portions 18 along section 7—7 are deflected apart a lesser amount than at the section 6—6. It is also illustrated that the sidewalls 12 and 14 of the body portion 8 are deflected resiliently away from one another. Also shown in phantom outline the body portions 14 at the section 7—7 are deflected away from one another a lesser amount.

In similar fashion with reference to FIG. 7, the body portions 18 in FIG. 7 illustrate the resilient deflection of the body portion at section 7—7 of FIG. 1. As shown in phantom outline, the sidewall portions 12 and 14 are deflected resiliently apart a lesser amount than the body portions 12 and 14 illustrated in phantom outline in FIG. 7, the phantom outlines illustrating the body portion at the section 6—6 of FIG. 1.

FIG. 1 illustrates that the sections 6—6 and 7—7 comprise sections of the body portion which are taken between the cutout portions 44, 46 and 48. Thus the body section 6—6 is defined between the cutout portions 44 and 46. The body section 7—7 is defined between the cutout portions 46 and 48. The presence of the cutout portions permit different degrees of flexing along the body portion as compared by the sections 6—6 and 7—7 along the body portion. Such different degrees of flexing however, are interdependent because the body sections yet remain joined integrally to each other. Accordingly flexing of the one body portion along the section 6—6 causes a corresponding deflection of the attached body portion taken along the section 7—7. Also, vice-versa, deflection of the body portion along section 7—7 causes a corresponding deflection along the section 6—6. Thus the cutouts provide two sections of the body portion which have different degrees of deflection while still being maintained connected with each other. Thus different degrees of deflection can only be accomplished only if there is a slight torsional stress placed on the body portions which join between the body at sections 6—6 and 7—7. Accordingly, such body portions defined at each of the sections 6—6 and 7—7 operate as torsional elements upon deflection as shown allowing but a limited length of the body to separate along its seam 20 upon resilient spread apart deflection of the spring arms 4 and 6.

By reference to FIGS. 4 and 5, the different modes of operation of the spring arms are illustrated in detail. FIG. 4 illustrates the position of the U-shaped ends 34 and 36 defining a relatively narrow receptacle throat area 54 therebetween. When forces are applied onto the U-shaped portions 34 and 36, as shown by the arrows in FIG. 5, the spring arms 4 and 6 are resiliently deflected outwardly of each other in cantilever fashion such that the U-shaped portions 34 and 36 are bent generally past one another and into substantial alignment with each other to widen the throat area 54 of the receptacle. The U-shaped portion 36 will engage or stop against the spring arm 6 to prevent excessive opening of the receptacle throat area or opening 54.

Figure 9:
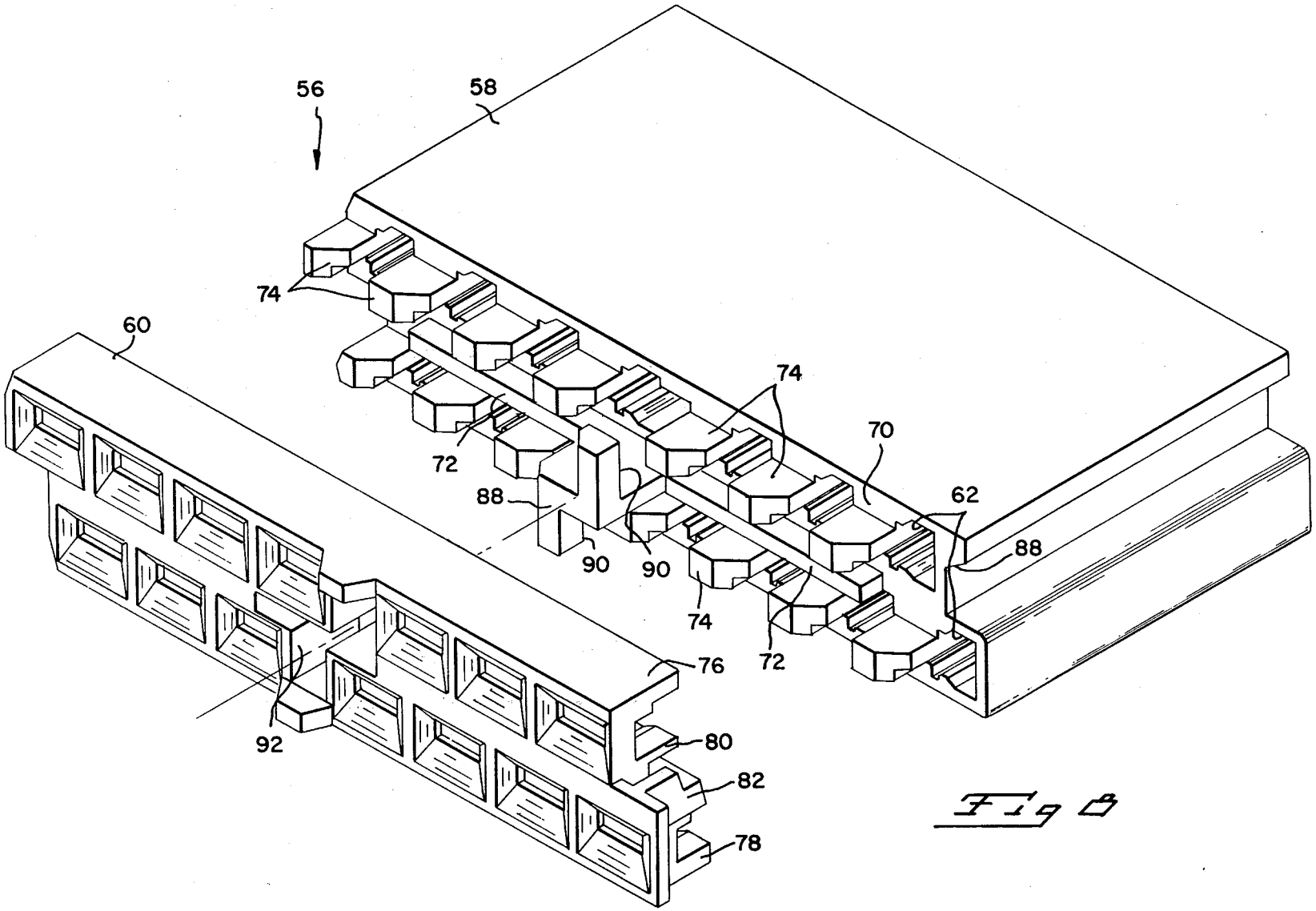
FIG. 9 is an enlarged elevation of the cover portion illustrated in FIG. 8.
Figure 9:
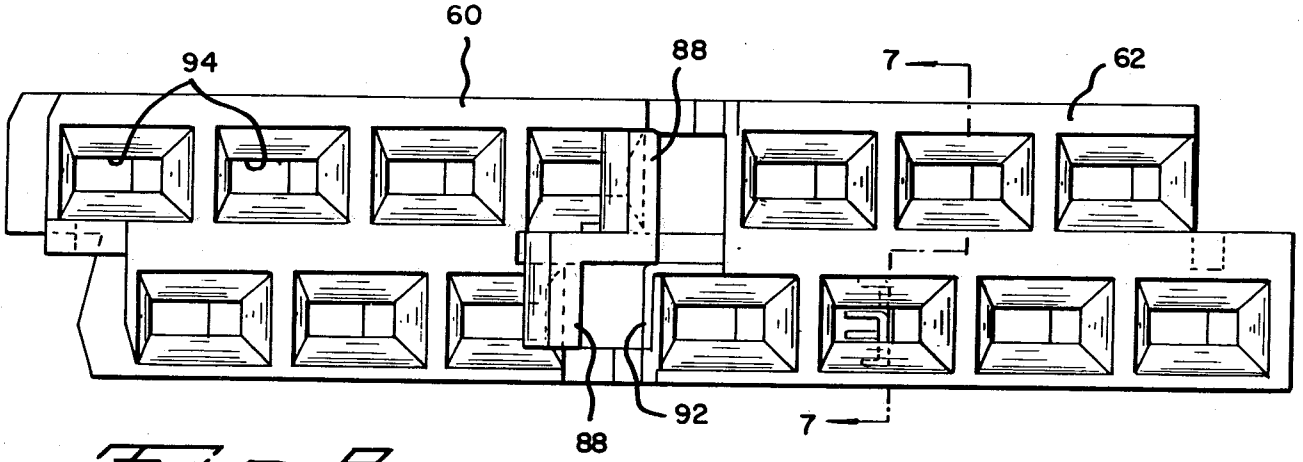
Figure 10:
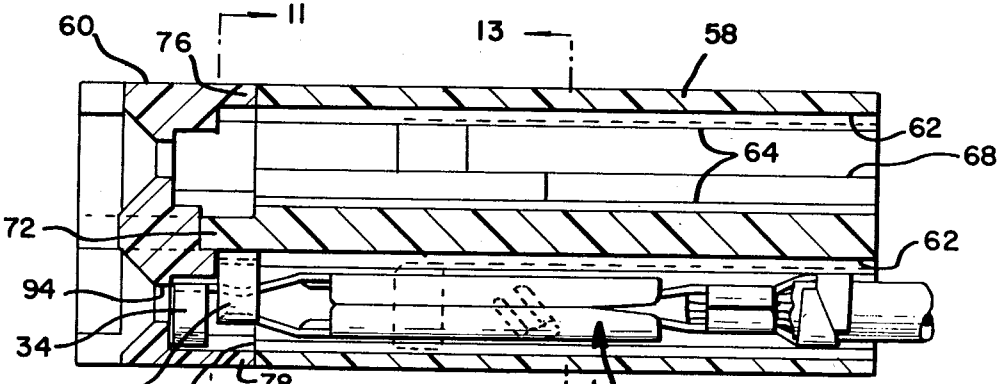
FIG. 10 is an enlarged section of the assembled cover and housing with a terminal in place.

By reference to FIGS. 8 through 14, a dielectric housing for containing a plurality of receptacles 1 according to the present invention will be described. FIG. 8 illustrates an enlarged exploded perspective, the housing illustrated generally at 56 as comprising two portions, a base 58 and a cover portion 60 of dielectric material. The base includes two rows of a plurality of cavities, some of which are illustrated at 62 for receiving corresponding rows of receptacles 1 therein. As shown in FIGS. 9, 10 and 13, the cover 60 is assembled over the base 58 in a manner to be described hereinafter. The housing cavities 62 include a narow neck portion 64 extending therethrough for receiving the terminal body portion 8 therein. The T-shaped flange 38 is inserted into a narrow portion of the opening 62 adjacent the neck portion 64 to stabilize and brace the body portion 8 within the corresponding cavities 62. The locking lance 39 is received in a recessed portion 66 of the housing in order to lock the receptacle in place and prevent its removal. Each cavity 62 is further provided with a generally rectangular adjacent opening of smaller size, which opening is illustrated at 68 intercepting the lance portion 39. A suitable tool may be inserted into the opening 68 to engage and force the lance portion 39 to deflect resiliently generally toward and into the body portion 8 to allow removal of the receptacle from the corresponding cavity 62 if desired. As shown in FIG. 10, the U-shaped portions 36 and 34 of each receptacle 1 protrude from an end 70 of the housing 58.

With reference to FIGS. 8 and 10, the end 70 of the housing is provided thereon with a central, projecting, generally elongated rectangular ridge 72 separating one row of terminals from the other. Each cavity 62 in each row is separated from the other cavities by an enlarged tab portion 74 generally of L-shaped cross-sectional configuration. The U-shaped portions 34 and 36 of each receptacle or contact 1 protrude from the housing into the space between the projecting tabs 74.

Figure 11:
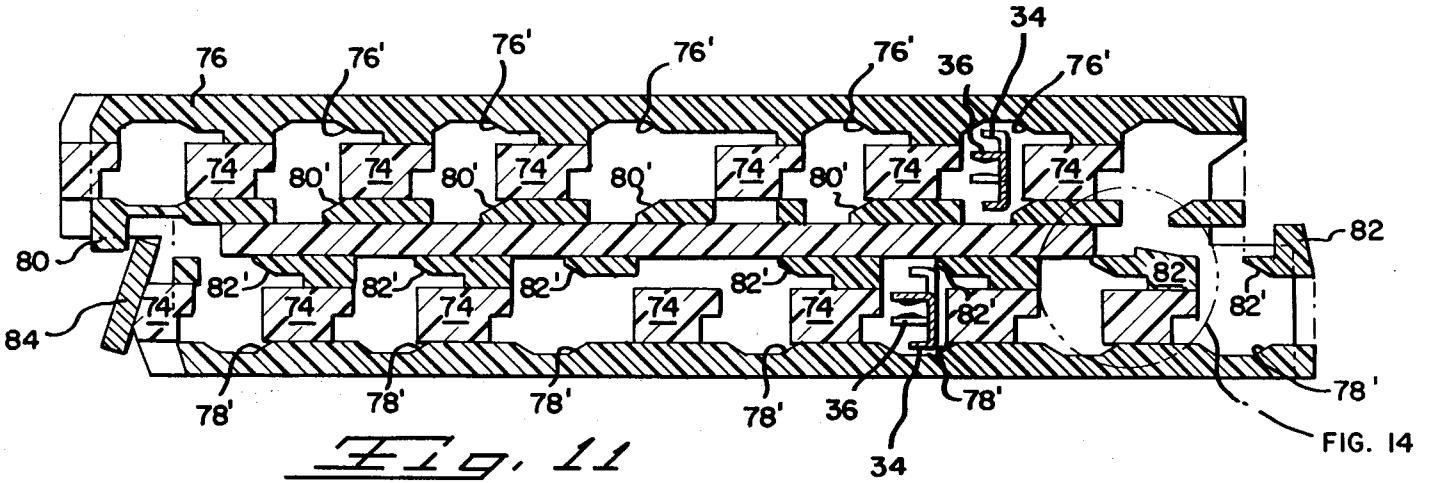
FIG. 11 is an enlarged section taken along the line 11—11 of FIG. 10.
Figure 12:
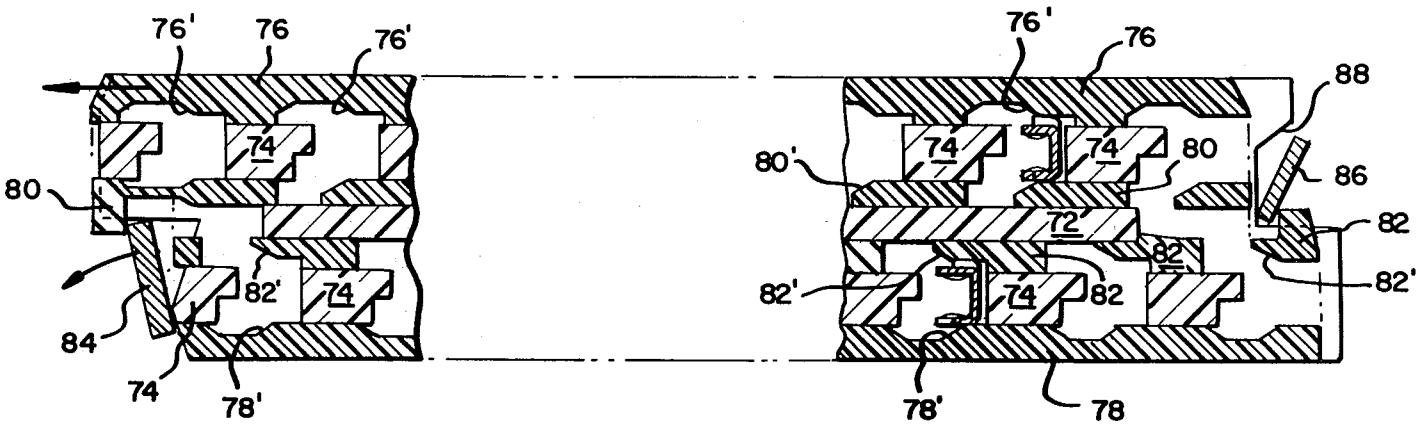
FIG. 12 is an enlarged fragmentary section similar to that of FIG. 11 and illustrating the exemplary terminal therein in an open position.

The cover portion 60 is provided with outer, generally continuous elongated sidewall portions 76 and 78, as shown in FIGS. 8 through 12. In addition, the cover portion is further provided with inner sidewalls 80 and 82 which are elongated parallel to the outer sidewalls 76 and 78, and which are each divided into a plurality of spaced segments. The inner sidewalls 80 and 82 project generally toward the housing. The ridge or projection 72 of the housing 58 is slidably received between the parallel inner walls 80 and 82. As shown in FIGS. 11 and 12, each segment of the wall 80 is provided with a sloped cam surface 80′ for a purpose to be described. In similar fashion, each segment of the inner wall 82 is provided with a sloped cam surface 82′ for a purpose to be described. Also in FIGS. 11 and 12, the outer sidewall 76 of the cover is provided with a plurality of spaced recesses therein, with the sidewalls of the recesses being defined by inclined cam surfaces 76′. The outer wall 78 of the cover further is provided with a plurality of recesses, the sidewalls of which are defined by inclined cam surfaces 78′. As shown more particularly in FIGS. 11 and 12, when the cover is assembled over the housing, the spaces between the tabs 74 define cavities in the cover into which the U-shaped portions 34 and 36 of the contacts are received. FOr example, the cavities of one row are defined, not only between such tabs 74, but also between adjacent segments 80 of one inner wall, and by the recessed portions of the outer wall 76. The additional row of cavities is defined, not only between the corresponding spaced tabs 74, but also between adjacent segments 82 of the inner wall, and by the recessed portions provided in the outer wall 78. An exemplary pair of U-shaped spring arm portions 34 and 36 are illustrated in FIGS. 11 and 12, received within a corresponding cavity. When the cover is slidably traversed to the left as shown in FIGS. 11 and 12, the wall portions 76, 80, 82 and 78 of the cover will traverse slidably along the stationary tabs 74 of the base. This forces the cam surfaces 76′ and 80′ into engagement upon the U-shaped portions 34 and 36 of the first row of receptacles or contacts camming them generally past each other to their configurations shown in FIGS. 5 and 12, thereby enlarging the relatively narrow throat areas 54 of the receptacles. In similar fashion, the lower row of receptacles have their U-shaped portions 34 and 36 cammed past each other upon engagement of the cam surfaces 78′ and 82′ thereon. As shown in FIG. 12, the U-shaped portions 34 and 36 of the first row of receptacles will be cammed into the clearance between the sidewalls 76 and 80 of the cover, while the other row of receptacles will have its U-shaped portions 34 and 36 forced into the clearance between the sidewalls 78 and 82. To move the cover to the left, as shown in FIGS. 11 and 12, a screw driver blade illustrated at 84 may be inserted into the clearance between the endmost tab 74 and a hook portion provided on the endmost one of the segments comprising the cover inner wall 80. Upon generally clockwise rotation of the screwdriver blade as shown in FIG. 12, the cover will be forcibly moved to the left. In FIG. 12, with the receptacle U-shaped portions opened as shown, the connector housing 56 may be pluggably received over male electrical terminals (not shown) which are readily insertable within the widened receptacle throat areas, without any resistance to insertion thereof. Since the U-shaped portions 34 and 36 are squeezed laterally between stationary sidewalls 76, 80, 82 and 78 of the cover, they may be readily retained in their open configuration without danger of the cover accidently being shifted to the right, as shown in FIG. 12. Instead, once the male terminals have been inserted, the cover is forcibly removed to the right in the figure by insertion of a screw driver blade 86 into the clearance between a hook portion of the endmost segment of the cover wall 82 and a recess 83 (FIGS. 8, 11 and 12) provided externally of the housing 58. Upon a twisting action of the blade 86, the cover will then be made to forcibly return, shifting to the right as shown in FIG. 12, allowing the U-shaped portions 34 and 36 of the rows of terminals to return to their positions shown in FIG. 11. Upon so doing, the U-shaped portions 34 and 36 will close and grip electrically and mechanically on the received male terminals to provide the desired electrical connections therewith.

By reference to FIGS. 8, 9 and 14, attachment of the cover 60 with respect to the base portion 58 will be described in detail. The base is provided with a substantially projecting Z-shaped portion 88, with a substantial clearance 90 formed underneath the arms of the Z-shaped portion and the projecting tabs 74. The Z-shaped portion 88 is initially freely received through a corresponding Z-shaped opening 92 of the cover 60. The clearances 90 permit the arms of the Z-shaped portion to project outwardly beyond the cover 62. In so doing, the cover is forcibly received over the housing 58. As shown in FIGS. 11 and 14, there is substantial interference between one segment of the cover inner wall 82 and the projecting ridge 72 of the housing 58. Such interference requires that the cover be forcibly received on the base portion 58 of the housing. However, when the cover 60 is forcibly moved to the right as shown in FIG. 11, the interfering segment of the cover inner wall 82 will remove itself from the ridge 72, relieving the interference fit. This is shown in FIG. 11 by the legend "FIG. 14" on the phantom outline encircled portion of the Figure. Thereafter, when the cover 60 is slidably reciprocated to the right or to the left as shown in FIGS. 11 and 12 to operate the camming action as described, the segment 82 of the cover inner wall will block itself against the end of the projecting ridge 72 of the housing, never allowing the cover to be moved so far to the left that it can be removed from the base portion 58. Thus, once the segment 82 is moved from interference with the projecting ridge 72, the cover will be restricted in its sliding motion back and forth on the housing base portion 58. The arms of the Z-shaped portion 88 will thus always remain projecting outwardly of the cover portion as shown in FIG. 9. Also with reference to FIG. 9, there is more particularly shown the cover portion 62 provided with a plurality of outwardly appearing apertures 94 through which the male electrical terminals (not shown) may be inserted for connection to the receptacle portions of the spring contacts. The openings 94 are specifically designed so as to cover the ends of the spring contacts when they are biased to their opened positions. This prevents snubbing of the U-shaped portions against the male terminals as they are being inserted. Thus the openings 94 may be encircled with tapered sidewalls as shown to provide a funnel entry, or funnel opening, of restricted size through which the male terminals must be guided and received in order for further receipt into the receptacle contact areas.

Figure 16:
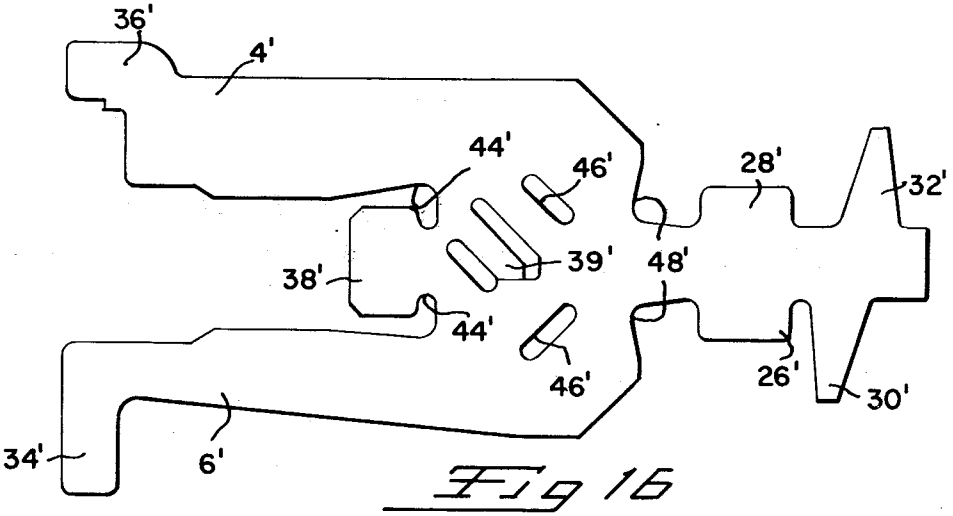
FIG. 16 is an enlarged plan view of a metal blank to be subsequently formed into the terminal illustrated in FIG. 15.
Figure 17:
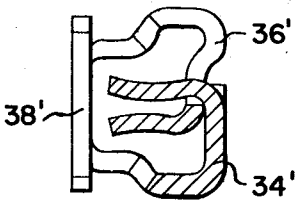
FIG. 17 is an enlarged cross-section of the ends of the terminal illustrated in FIG. 15.
Figure 15:
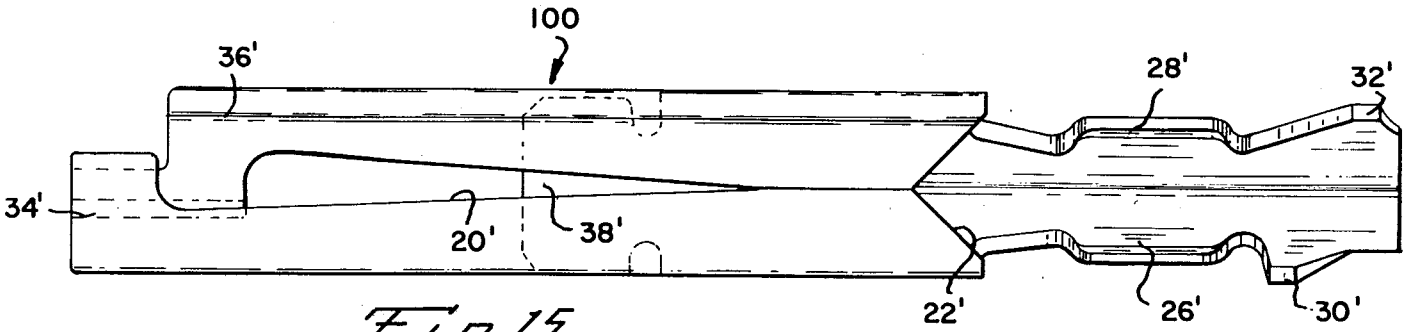
FIG. 15 is an enlarged plan view of another embodiment of a terminal according to the present invention.

With more particular reference to FIGS. 15, 16 and 17, another preferred embodiment of the present invention will be described. Such figures illustrate an alternate form of terminal illustrated generally at 100. As in the embodiment shown in FIGS. 1 - 5, the embodiment illustrated in FIGS. 15 - 17 will have similar parts referred to with the same numerals but with primed designations. Accordingly, the embodiment shown in FIGS. 15 - 17 include a terminal formed into a box configuration with spring arms 4' and 6' having a receptacle throat area defined by overlapped generally U-shaped portions 34' and 36'. The terminal has a body portion formed into a box-like configuration with the overlapped margin 20' and the dovetail recess 22' formed along the margin 20'. In this embodiment, the margin 20' is initially opened up rather than closed as in the prior embodiment. In addition, the terminal further includes cutout portions 44', 46' and 48' similar to those in the prior embodiment. Tab portions 26' and 28' provide a conductor crimping barrel, with tabs 30' and 32' providing an insulation crimping barrel similar to the terminal described before. The terminal further includes a stabilizing fin 38' and a locking lance 39'. In this embodiment as shown in FIG. 17, the U-shaped portions are bent to a corrugated U-shaped configuration as shown. This embodiment differs from the prior terminal in that the margin 20' is initially widened. When the U-shaped portions 34' and 36' are squeezed together, for example, by the camming action of the cover 60 slidable on the housing base 58 which may receive the terminal 100 within a housing cavity 62, the margin 20' closes up, whereas in the previous embodiment it opens up. This embodiment therefore eliminates the need for converging spring elements 4 and 6 as in the prior embodiment shown in FIGS. 1 - 5. In all additional aspects of operation, however, the two embodiments work the same, each requiring resilient deflection of both the spring arms and the body portion to provide the necessary resilient gripping force at the receptacle throat area, and further requiring the torsional elements defined by the cut-outs in the body portions.

Although preferred embodiments and modifications thereof are disclosed in detail, other embodiments and modifications of the present invention which would become obvious to one having ordinary skill in the art are intended to be covered by the spirit and scope of the appended claims.

What is claimed is:

1. An electrical terminal, comprising:

a body portion and a wire engaging portion and a pair of projecting and normally spaced apart resilient spring arms having U-shaped ends, said spring arms having gripping surfaces thereon, said U-shaped ends being resiliently biased into mutual tandem alignment whereby said gripping surfaces are separated to freely receive therebetween a male terminal inserted into each of said U-shaped ends, said spring arms being resiliently deflected outwardly away from each other when said U-shaped ends are biased into mutual tandem alignment, said U-shaped ends being capable of resilient deflection out of tandem alignment to allow said spring arms to deflect toward each other whereby to engage the gripping surfaces thereof on a male terminal, and said body portion includes a plurality of cutout portions defining sections of the body portion having different degrees of resilient deflection as a reaction to resilient deflection of said spring arms toward each other.

2. An electrical terminal, comprising:

a body portion and a wire engaging portion and a pair of projecting and normally spaced apart resilient spring arms having U-shaped ends, said spring arms having gripping surfaces thereon, said U-shaped ends being resiliently biased into mutual tandem alignment whereby said gripping surfaces are separated to freely receive therebetween a male terminal inserted into each of said U-shaped ends, said spring arms being resiliently deflected outwardly away from each other when said U-shaped ends are biased into mutual tandem alignment, said U-shaped ends being capable of resilient deflection out of tandem alignment to allow said spring arms to deflect toward each other whereby to engage the gripping surfaces thereof on a male terminal, said body portion being folded into an elongated closed box configuration having a longitudinal seam, said body portion being folded in compression along said seam, said arms being joined to one end of said body portion, the other end of said body portion having said projecting wire engaging portion and an open notch along said seam, and said notch tending to close by resilient deflection of said body and the reaction to resilient deflection of said spring arms outwardly away from each other.

3. The structure as recited in claim 2, wherein, said body portion includes a plurality of cutout portions defining sections of the body portion having different degrees of resilient deflection as a reaction to resilient deflection of said spring arms outwardly away from each other.

4. A one-piece terminal, comprising:

a pair of elongated spring arms extending in cantilever fashion from a body portion formed into a box configuration with a single open seam and with opposed first sidewalls and with a second sidewall formed by a pair of folded elongated margin portions separated by said seam which partially opens and partially closes in response to resilient deflections of said body portion, a pair of jaws at corresponding ends of said spring arms, said jaws defining therebetween a resilient electrical receptacle throat having a width variable by resilient cantilever deflection of said spring arms toward and away from each other and by resilient deflection of said body portion in response to said cantilever deflection of said spring arms, said seam partially opening when said spring arms are resiliently deflected toward each other, and said body portion being provided with cutout portions in said first sidewalls.

* * * * *